US005109822A

United States Patent [19]

Martin

[11] Patent Number: 5,109,822

[45] Date of Patent: May 5, 1992

[54] HIGH PRESSURE ELECTRONIC COMMON-RAIL FUEL INJECTION SYSTEM FOR DIESEL ENGINES

[76] Inventor: Tiby M. Martin, 3836 Holly La., Waterloo, Iowa 50702

[21] Appl. No.: 621,372

[22] Filed: Nov. 30, 1990

Related U.S. Application Data

[62] Division of Ser. No. 508,068, Apr. 11, 1990, Pat. No. 5,035,221, which is a division of Ser. No. 295,588, Jan. 11, 1989, abandoned.

[51] Int. Cl.[5] ..... F02M 37/00

[52] U.S. Cl. ..... 123/456; 123/447; 137/883

[58] Field of Search ..... 123/447, 452, 463, 494, 123/451, 456; 137/597, 883, 561 A, 884

[56] References Cited

U.S. PATENT DOCUMENTS

| | | | |
|---|---|---|---|
| 2,937,636 | 5/1960 | Aldinger | 123/452 |
| 3,331,327 | 7/1967 | Roosa . | |
| 3,552,436 | 1/1971 | Stewart | 137/883 |
| 3,572,368 | 3/1971 | Bullmer | 137/884 |
| 3,795,259 | 3/1974 | Brandin | 137/561 A |
| 3,804,118 | 4/1974 | Love | 137/883 |
| 3,827,409 | 8/1974 | O'Neill | 123/447 |
| 3,928,711 | 12/1975 | Jakobsen | 137/883 |
| 4,509,691 | 4/1985 | Skinner . | |
| 4,527,737 | 7/1985 | Deckard . | |
| 4,539,959 | 9/1985 | Williams | 123/456 |
| 4,550,875 | 11/1985 | Teerman et al. . | |
| 4,603,671 | 8/1986 | Yoshinaga et al. . | |
| 4,922,958 | 5/1990 | Lemp | 123/456 |

FOREIGN PATENT DOCUMENTS 2118624 11/1963 United Kingdom .

OTHER PUBLICATIONS

SAE Technical Paper Series 880421, "EMI-Series--Electromagnetic Fuel Injection Pumps" by Michael M. Schechter and Aladar O. Simko (1988) no month provided.

SAE Technical Paper Series 881098, "EEC IV Full Authority Diesel Fuel Injection Control" by William Weseloh (1986) no month provided.

SAE Technical Paper Series 850453, "An Electronic Fuel Injection System for Diesel Engines" by P. E. Glikin (1985) no month provided.

SAE Technical Paper Series 840273, "Direct Digital Control of Electronic Unit Injectors" by N. John Beck, et al. (1984) no month provided.

SAE Technical Paper Series 810258, "Electronic Fuel Injection Equipment for Controlled Combustion in Diesel Engines" by R. K. Cross, et al. (1981) no month provided.

*Primary Examiner*—Carl Stuart Miller

*Attorney, Agent, or Firm*—Woodward, Emhardt, Naughton, Moriarty & McNett

[57] ABSTRACT

A fuel injection system having a novel electromagnetic-actuated fuel pump in which four pumping elements, equally-spaced around a camshaft are mounted such that a pair of opposed pumping elements alternate to deliver pressure to a high pressure common rail with a second pair of pumping elements. In one embodiment of the invention the pumping elements are mechanically actuated, in another they are electronically actuated. The high pressure common rail is adapted to reduce surges in the fuel pressure from the pump up to levels of 20,000 psi. The common rail has a relief valve for controlling the maximum pressure in the common rail chamber. The electromagnetic injection nozzle has a needle valve that is closed by pressure in a balancing chamber having a reduced pressure level less than that of the pressure required to open the valve. When the supply fuel flow is blocked, the valve is closed by a spring, assisted by the pressure in the balancing chamber which overbalances the needle valve when the nozzle pressure has dropped by the termination of the supply fuel flow.

1 Claim, 8 Drawing Sheets

HIGH PRESSURE ELECTRONIC COMMON-RAIL FUEL INJECTION SYSTEM FOR DIESEL ENGINES

This application is a division, of application Ser. No. 07/508,068, filed Apr. 11, 1990, now U.S. Pat. No. 5,035,221 which was a division of application Ser. No. 07/295,588, filed Jan. 11, 1989, now abandoned.

BACKGROUND OF THE INVENTION

This invention is related to a high-pressure, common rail, fuel injection system for injecting metered amounts of highly pressurized fuel into the cylinder of a diesel engine.

Conventional fuel injection systems employ a "jerk" type fuel system for pressurizing and injecting fuel into the cylinder of a diesel engine. A pumping element is actuated by an engine-driven cam to pressurize fuel to a sufficiently high pressure to unseat a pressure-actuated injection valve in the fuel injection nozzle.

In one form of such a fuel system having an electromagnetic unit injector, the plunger is actuated by an engine driven cam to pressurize the fuel inside the bushing chamber when a solenoid is energized and the solenoid valve is closed. The metering and timing is achieved by a signal from an electronic control module (ECM) having a controlled beginning and a controlled pulse.

In another form of such a fuel system, the fuel is pressurized by an electronic or mechanical pumping assembly into a common rail and distributed to electromagnetic nozzles which inject pressurized fuel into the engine cylinder. Both the electronic pump and the electromagnetic nozzles are controlled by the ECM signal.

One problem with using a common rail results from the high pressures experienced in diesel engines, in the neighborhood of 20,000 psi.

Another problem in conventional fuel injection systems lies in achieving a controlled duration and cut-off of the fuel injection pressure. Standard fuel injection systems commonly have an injection pressure versus time curve in which the pressure increases to a maximum and then decreases to form a somewhat skewed, triangularly-shaped curve. Such pressure versus time relationship initially delivers a relatively poor, atomized fuel penetration into the engine cylinder because of the low injection pressure. When the pressure curve reaches a certain level, the pressure provides good atomization and good penetration. As the pressure is reduced from its peak pressure, the decreasing pressure again provides poor atomization and penetration, and the engine discharges high emission particulate and smoke.

One of the objects of fuel injection designers is to reduce unburned fuel by providing a pressure vs. time curve having a squared configuration, with an initially high pressure increase to an optimum pressure providing good atomization, and a final sharp drop to reduce the duration of poor atomization and poor penetration.

Examples of some prior art fuel injection nozzles may be found in U.S. Pat. No. 4,527,737 which issued Jul. 9, 1985 to John I. Deckard; U.S. Pat. No. 4,550,875 which issued Nov. 5, 1985 to Richard F. Teerman, Russell H. Bosch, and Ricky C. Wirth; U.S. Pat. No. 4,603,671 which Aug. 5, 1986 to Turo Yoshinaga, et al.; U.S. Pat. No. 3,331,327 which issued to Vernon E. Roosa on Jul. 18, 1967; and U.S. Pat. No. 4,509,691 which issued Apr. 9, 1985 to Robert T. J. Skinner.

Literature pertaining to electromagnetic fuel injection pumps may be found in Paper No. 880421 of the SAE Technical Paper Series entitled "EMI—Series—ELECTROMAGNETIC FUEL INJECTION PUMPS" discussed at the Feb. 29–Mar. 4, 1988 International Congress & Exposition at Detroit, Mich. Other literature pertaining to the subject include: SAE Technical Paper Series No. 840273 discussed Feb. 27–Mar. 2, 1984 at the International Congress & Exposition, Detroit, Mich.; SAE Technical Paper Series 850453 entitled "An Electronic Fuel Injection System for Diesel Engines" by P. E. Glikin discussed at the International Congress & Exposition at Detroit, Mich. on Feb. 25, 1985; SAE Technical Papers Series 810258 by R. K. Cross, P. Lacra, C. G. O'Neill entitled ELECTRONIC FUEL INJECTION EQUIPMENT FOR CONTROLLED COMBUSTION IN DIESEL ENGINES, dated Feb. 23, 1981; SAE Technical Paper Series 861098 entitled EEC IV—FULL AUTHORITY DIESEL FUEL INJECTION CONTROL by William Weseloh presented Aug. 4, 1986; and, United Kingdom Patent Application No. GB-2118624A filed Mar. 3, 1983 by Henry Edwin Woodward.

SUMMARY OF THE INVENTION

The broad purpose of the present invention is to provide an improved high pressure common rail, fuel injection system. In the preferred embodiment, the system employs a novel electro-magnetic nozzle having a needle valve with an inner end attached to a piston that forms one wall of an accumulator or balancing chamber. Fuel is delivered to the nozzle by a solenoid-actuated valve. The high pressure fuel biases the needle valve to an open position. A portion of the high-pressure fuel is by-passed to the balancing chamber to urge the piston and the needle valve towards their closed position.

Initially, the pressure acting to open the needle valve is about 20,000 psi. The balancing chamber pressure by virtue of certain orifices, has an internal pressure of only about 7,000–8,000 psi.

When the fuel supply to the needle valve is terminated, the fuel pressure biasing the needle valve open begins to fall off. When the needle valve pressure is reduced to a level less than that in the accumulator chamber, the pressurized fuel in the balancing chamber, together with a spring, cooperate in quickly closing the needle valve. The result is a sharp cut-off pressure thereby reducing the duration of the tail end of the injection curve that customarily provides poor penetration and atomization.

The system employs a novel multi-element fuel pump. Four plunger-actuated pumping elements are mounted about a camshaft having a pair of lobes. When the camshaft turns 90 degrees, it moves a first pair of opposed plungers in a delivery motion, and the other two plungers in a suction motion. As the camshaft continues its rotation, the two pair of pumping elements alternate in delivering fuel toward a common rail.

In one embodiment, the pump is actuated by a solenoid-actuated valve in response to an electrical signal from an electronic control module.

In another embodiment, the pumping elements are mechanically actuated.

Two forms of common rails are disclosed. In both forms the common rail has a one-piece metal housing.

Fuel is delivered from the pump in one direction into the common rail, and discharged in a direction at right angles to the injection nozzles.

One form of common rail has a relatively flat metal body with a series of parallel, relatively large diameter bores. Some of the bores are capped off and the others connected to the pump. The body has a second series of smaller bores, at right angles to the first set of bores. Each end of the smaller bores is capped off with a discharge fitting. The pressure in the body is controlled by a relief valve. By adjusting the relief valve, the fuel pressure to the fuel injection nozzles is maintained constant during the duration of the injection process.

Still further objects and advantages of the invention will become readily apparent to those skilled in the art to which the invention pertains upon reference to the following detailed description.

DESCRIPTION OF THE PREFERRED EMBODIMENT

Figure 1:
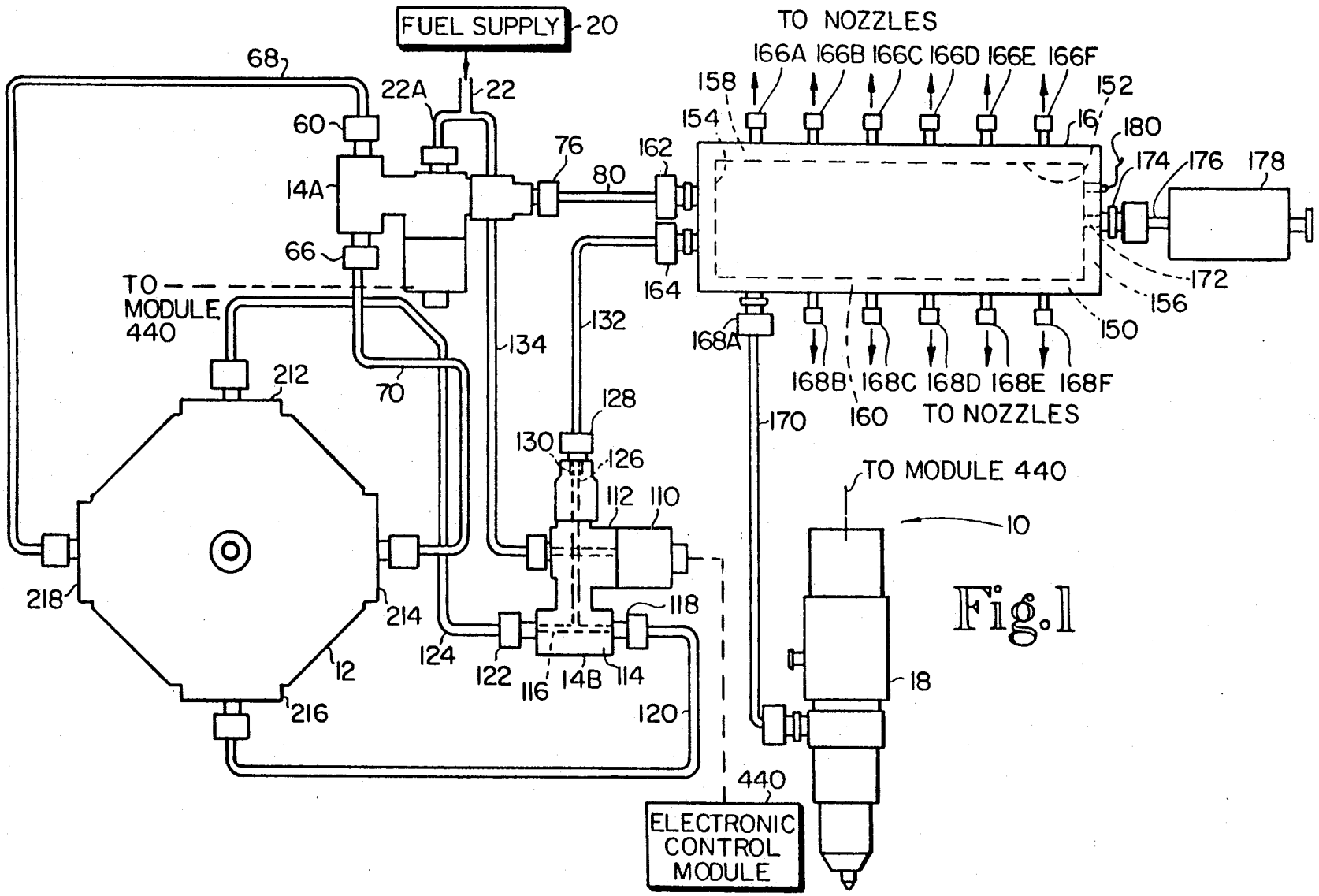
FIG. 1 illustrates a high-pressure, common-rail fuel injection system illustrating the preferred embodiment of the invention.

Referring to the drawings, a preferred fuel injection system 10 comprises an electronic pump means 12, solenoid valve means 14A and 14B, a common rail assembly 16 and an electro-magnetic nozzle means 18.

Fuel is delivered from a fuel supply 20 through conduit means 22 to solenoid valve means 14A and 14B. The two valve means 14A and 14B are identical in construction, their function differing according to their fluid connection with pump means 12.

Figure 4:
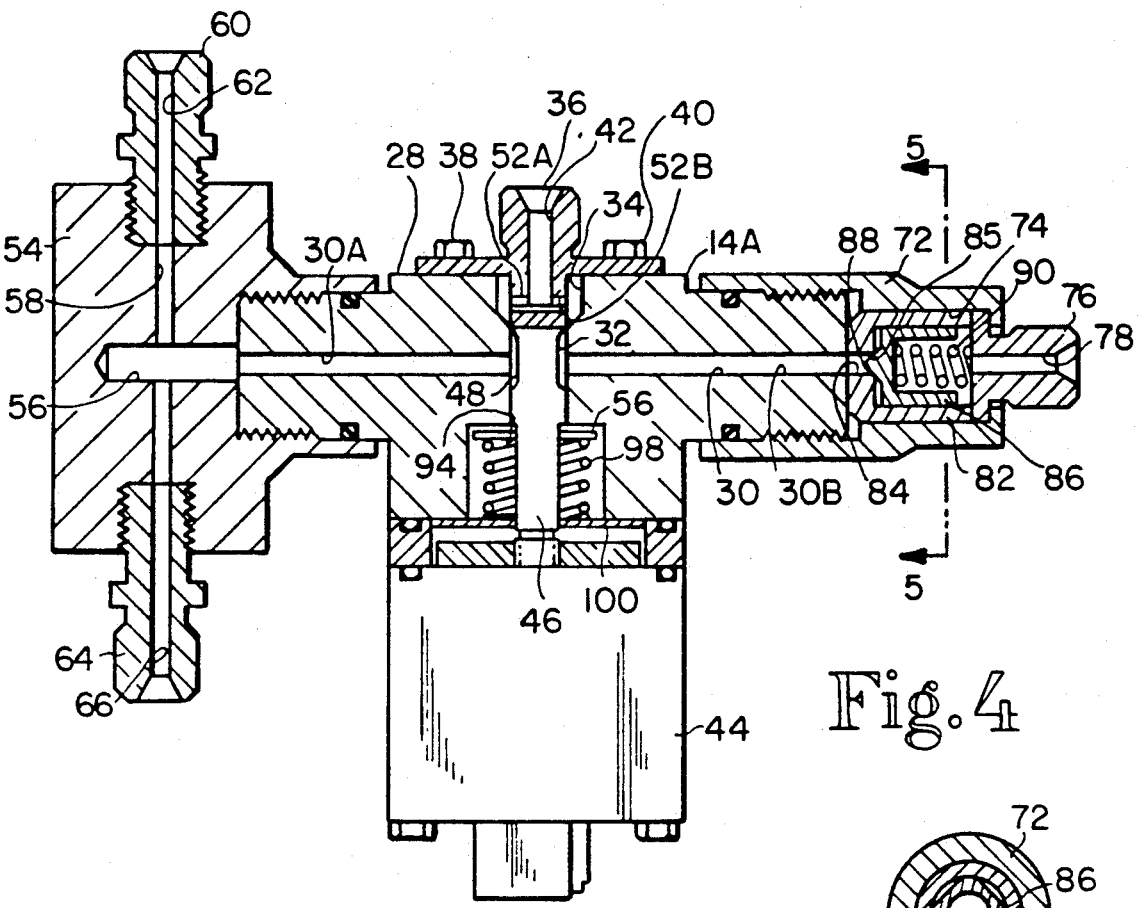
FIG. 4 is a view of a preferred solenoid valve assembly.

Referring to FIG. 4, solenoid valve means 14A comprises a body 28 having an longitudinal passage 30 including halves 30A and 30B. A transverse passage 32 extends at right angles to passage 30 and intersects passage 30. One end of passage 32 is enlarged at 34. A fuel inlet fitting 36 is mounted in enlarged passage 34. A pair of fasteners 38 and 40 fasten fitting 36 to the body. Fitting 36 has a passage 42 for receiving fuel from conduit means 22A.

Figure 5:
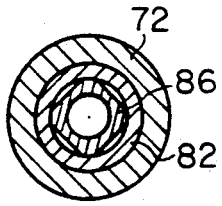
FIG. 5 is a sectional view as seen along lines 5—5 of FIG. 4.
Figure 5A:
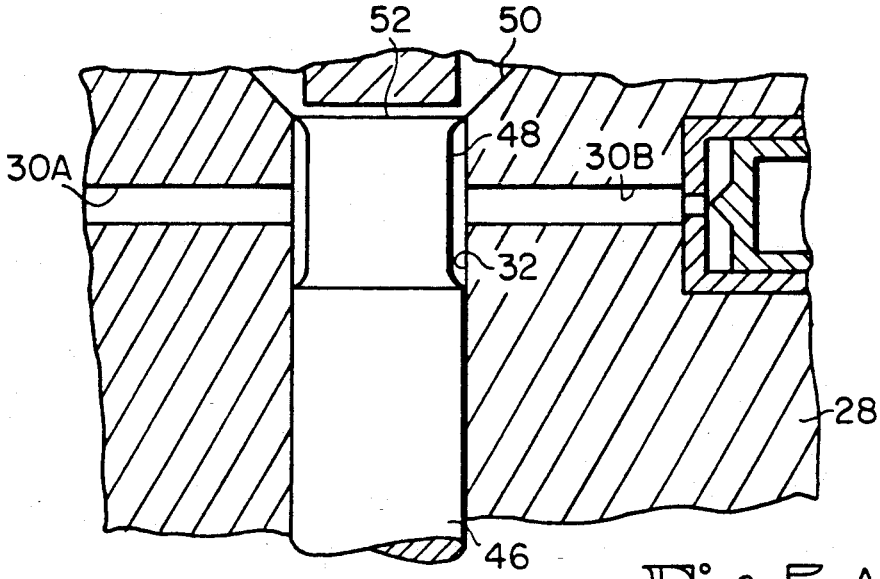
FIG. 5A is an enlarged fragmentary view of the solenoid valve in a position for delivering fuel to the common rail.
Figure 5B:
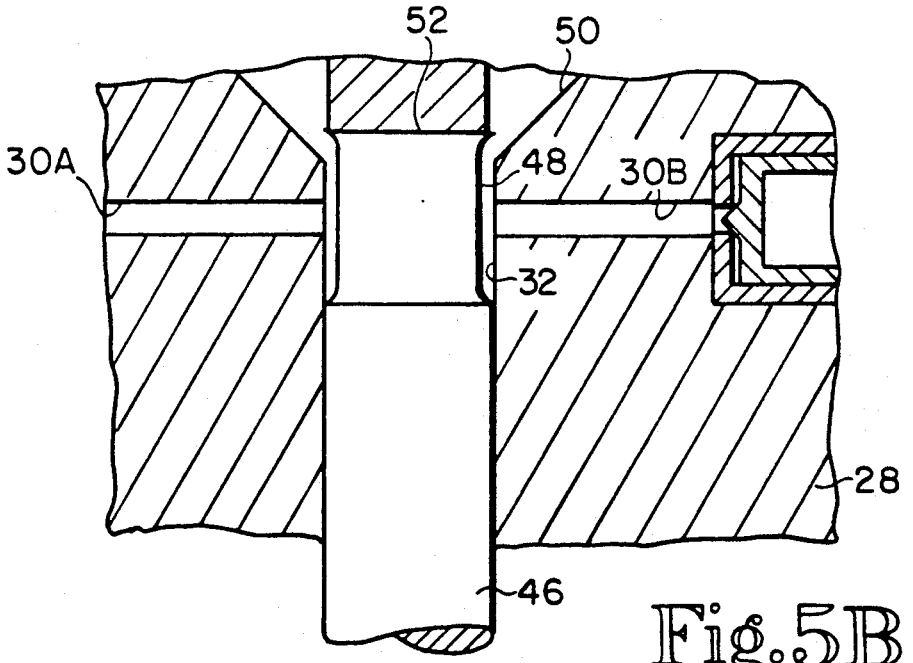
FIG. 5B is a enlarged fragmentary view showing the solenoid valve disposed for bypassing the fuel.

Referring to FIGS. 4, 5A and 5B, an electrically-operated solenoid 44 is mounted on the body and is operatively connected to control valve 46 which is slidably disposed in passage 32 for reciprocatory motion. Valve 46 has an annular groove 48 spaced from the outer end of the valve.

The bottom of the enlarged end of bore 34 is tapered at 50 to provide a seat for outer end 52 of valve 46.

Solenoid 44 is operative to move the control valve between a closed position (FIG. 5A) in which valve end 52 engages seat 50 to block fluid flow between passage 42 and an open position (FIG. 5B) in which the control valve abuts fitting 36 to open fluid flow between passage 32 and a pair of passages 52A and 52B in fitting 36 to passage 42. In both positions, there is a fluid connection between the two halves 30A and 30B of passage 30.

Referring to FIG. 4, nut 54 is mounted on one end of the body. Nut 54 has an internal passage 56 forming an extension of passage 30A. The nut has a second passage 58 at right angles to and intersecting passage 56. A fitting 60 is mounted on the nut and has an internal passage 62 forming an extension of one end of passage 58.

A second fitting 64 is mounted on the opposite end of the nut and has an internal passage 66 forming an extension of the opposite end of passage 58.

Referring to FIG. 1, conduit 68 forms a fluid connection between fitting 60 and pump means 12, and another conduit 70 forms a fluid connection between fitting 64 and pump means 12.

Returning to FIGS. 1, 4 and 5, a nut 72 is mounted on the opposite end of body 28. Nut 72 has an internal chamber 74. A threaded fitting 76 is mounted on nut 72. Fitting 76 has a passage 78 connected to a conduit 80. A cup-shaped member 82 is mounted in chamber 74. Member 82 has a cylindrical internal wall, and an opening 84 communicating with passage 30B which forms a valve seat 85 for a slidably mounted, hollow check valve 86. Check valve 86 has a conical end 88 which mates with valve seat 85 to close fluid flow from passage 30 into chamber 74. A spring bias member 90 is mounted in the check valve and biases it toward its closed position.

Referring to FIG. 5, check valve 86 has a square cross-section slidably mounted in the cylindrical internal wall of member 82 to permit fuel flow from passage 30 into chamber 74 when conical end 88 is spaced from the valve seat.

Still referring to FIG. 4, when solenoid means 44 is electrically energized, it retracts the control valve away from fitting 36 to open fluid flow between passage 32 and passage 42.

The control valve has an annular shoulder 94. A washer 96 is mounted on the shoulder. A return spring 98 is disposed between the washer and a retainer 100 to bias the control valve toward fitting 36 and the control valve's open position.

In operation, when the control valve is seated in its closed position, fluid flow is blocked between passage 32 and 22A. When check valve 86 is opened, fuel passes from the pumping means through passages 30A and 30B and out to conduit 80. When the control valve is raised to engage fitting 36 in the valve's open position, the fuel passes from passage 30A and out conduit 22A, when check valve 86 is closed.

Referring to FIG. 1, the second solenoid assembly 14B is identical in construction to solenoid 14A and includes a solenoid 110 mounted on a body 112. A nut 114 is mounted on one end of the body and has an internal passage 116. One end of passage 116 is connected by fitting 118 and conduit 120 to the pump assembly.

The opposite end of passage 116 is connected by fitting 122 and conduit 124 to the pump means in a manner which will be described. The body has internal passage means 126, one end of which is connected to passage 116 and the other end which terminates with fitting 128. A check valve 130 provides means for opening and closing fuel flow from the body to a conduit 132 which is connected to common rail 16. Fuel is received from fuel supply 20 through a conduit 134. Solenoid 110 moves control valve 111 to control fluid flow between passage 126 and conduit 134 in the manner that control valve 46 controls flow between passage 30 and conduit 22A.

Fuel is discharged from conduits 80 and 132 to common rail 16.

Figure 6:
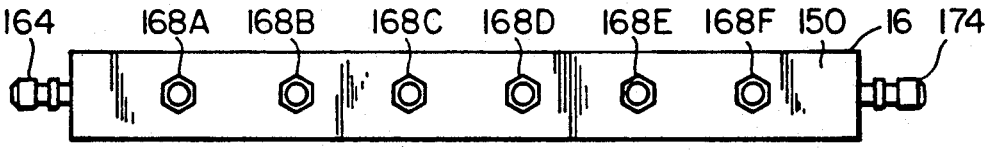
FIG. 6 is a side view of the common rail of FIG. 1.

Referring to FIGS. 1 and 6, common rail 16 has a relatively flat metal body 150. Body 150 has an internal chamber 152 bounded by end walls 154 and 156, and side walls 158 and 160.

The side walls and the end walls are joined in a rectangular configuration.

End wall 154 has a pair of inlet fittings 162 and 164. Fitting 162 is connected to conduit 80 for receiving fuel from solenoid valve assembly 14A into the common rail chamber. Fitting 164 is adapted to receive fuel from the solenoid valve assembly 14B through conduit 132.

Side wall 158 has six fluid discharge fittings 166A through 166F.

The opposite side wall 160 has fluid discharge fittings 168A through 168F. Each of the fittings 166A through 166F, and 168A through 168F is connected by a conduit such as conduit 170 to an electromagnetic nozzle typified by nozzle means 18.

End wall 156 has an outlet opening 172. A fitting 174 is mounted in the outlet opening and connected by a conduit 176 to an adjustable relief valve 178. Adjustable relief valve is adapted to relieve the pressure in chamber 152 when it exceeds a predetermined level.

A pressure transducer 180 is also mounted in end wall 156 and connected to a remote indicator (not shown) for monitoring the pressure in chamber 152.

Figure 3:
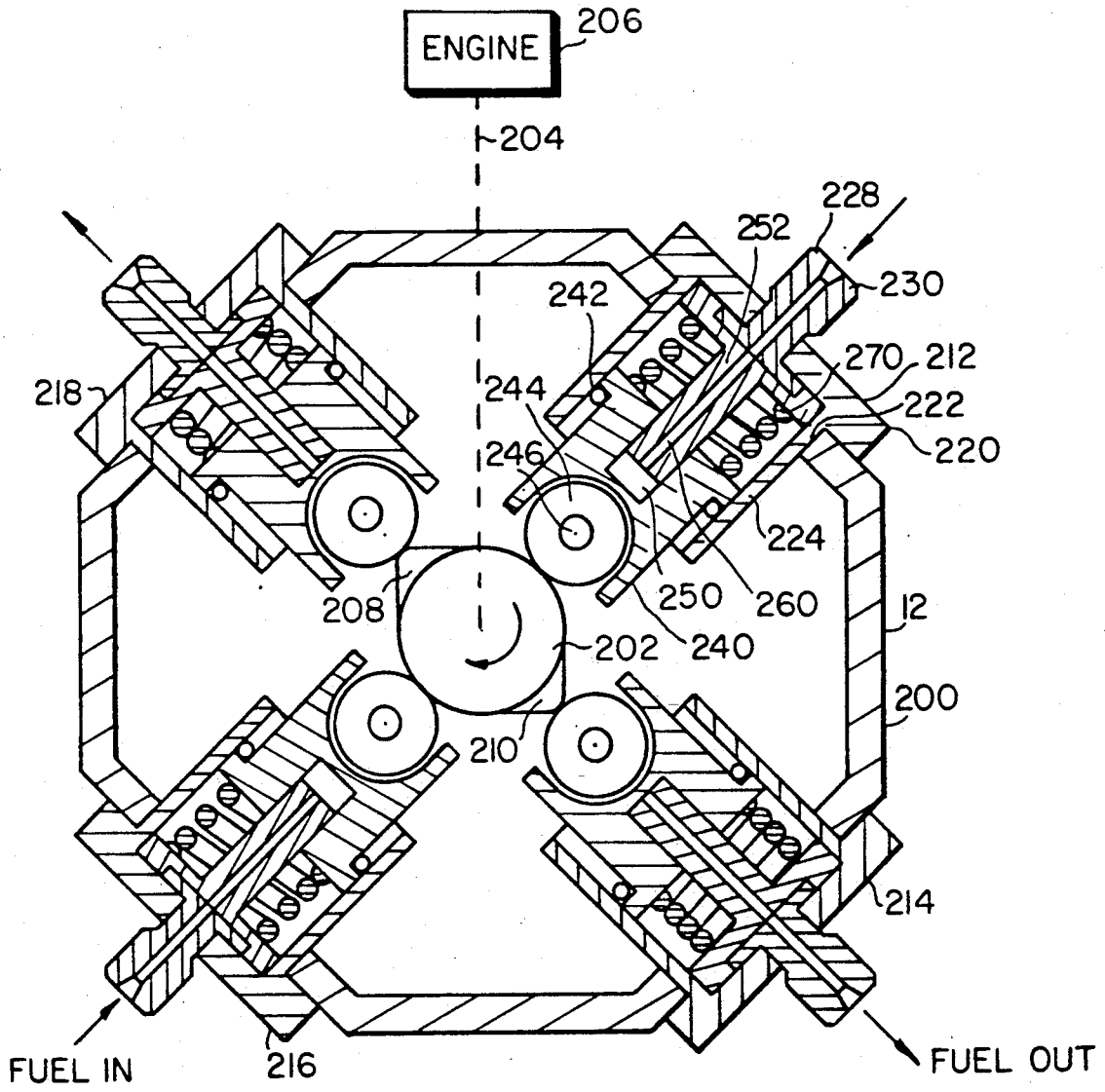
FIG. 3 is a view of an electronically-actuated pump assembly illustrating the preferred fuel pump.

Referring to FIGS. 1 and 3, fuel pump means 12 comprises a housing 200. A camshaft 202 is mounted in the housing and connected by mechanical connection 204 to the engine 206 being supplied by the fuel delivery means.

The camshaft has two lobes 208 and 210 mounted 180 degrees apart.

Four identically constructed pumping means 212, 214, 216 and 218 are mounted on the housing, spaced 90 degrees with respect to one another about the axis of rotation of the camshaft. Pumping means 212 is typical of the four and includes a mounting flange 220 disposed in an opening 222 in the pump housing. The flange carries a cylindrical skirt 224 and supports a fitting 228 having an internal passage 230.

A tappet bushing 240 is mounted in skirt 224. A retaining ring 242 is carried by the bushing and slidably mounted on the inner surface of skirt 224.

A tappet 244 is rotatably mounted on a pin 246 carried by the bushing. The tappet is rotatably engaged with the camshaft such that the bushing is movable within the skirt depending upon the position of the camshaft.

The bushing has an internal bore 250. A plunger 252 is slidably mounted within the bore to form a pumping chamber 256 which expands and contracts depending upon the position of the tappet on the camshaft. The plunger has an internal passage 260 for passing fuel toward or away from pumping chamber 256. The arrangement is such that as the tappet rides up on either camshaft lobe 208 or lobe 210, the tappet moves the bushing toward the plunger to reduce the size of pumping chamber 256, thereby delivering fuel under pressure through passage 230. As the camshaft is rotated so the tappet is riding on the back side of the camshaft lobe, a spring bias member 270 having one end engaged with the plunger and its other end engaged with the bushing, urges the bushing toward the camshaft to enlarge chamber 256. As pumping chamber 256 is enlarged, the chamber creates a low pressure area drawing fuel into the chamber through the passage in the plunger.

Thus it can be seen that as the camshaft is rotated, it simultaneously pumps fuel out of the pumping chambers of pumping means 214 and 218, while drawing fuel into the pumping chambers of pumping means 212 and 216. As the camshaft continues its rotation, the fuel is drawn into the pumping chamber of pumping means 214 and 218, and pumped out of the pumping chambers of pumping means 212 and 216. This provides a pumping action having a balanced motion of the pumping components.

Referring to FIG. 1, pumping means 212 and 216 are connected by conduits 124 and 120, respectively, to solenoid assembly 14B.

Similarly, pumping means 214 and 216 are connected by conduits 70 and 68, respectively, to solenoid assembly 14A. The pumping means either pump fuel toward the common rail or recirculate it to the fuel supply conduits depending upon whether the check valves in the solenoid valves are open or closed. The check valves are open or closed depending upon the pressure in common rail chamber 16 which in turn is a function of the relief valve adjustment and the fuel flow through the electromagnetic nozzles.

Referring to FIGS. 7, 7A, 7B, 7C and 7D, a typical electromagnetic nozzle 18 comprises a body 300 having a nut 302 threadably mounted at its upper end; and a retaining cap 304 mounted at its lower end. An electrically-actuated solenoid 306 is mounted on the nut. The solenoid has an armature 308 disposed in a chamber 310 which defines the travel of the armature. Solenoid 306 is seated in a cavity 310 by means of "O" ring 312.

The armature of the solenoid is connected to an elongated valve 314 which extends through a chamber 316 in the nut. Valve 314 is slidably mounted in bore 318 in the body. The valve has an internal longitudinal passage 320. A cross-passage 322 has its ends communicating with chamber 316 (FIG. 7E) which in turn communicates with passage 324 in fitting 326.

Figure 7:
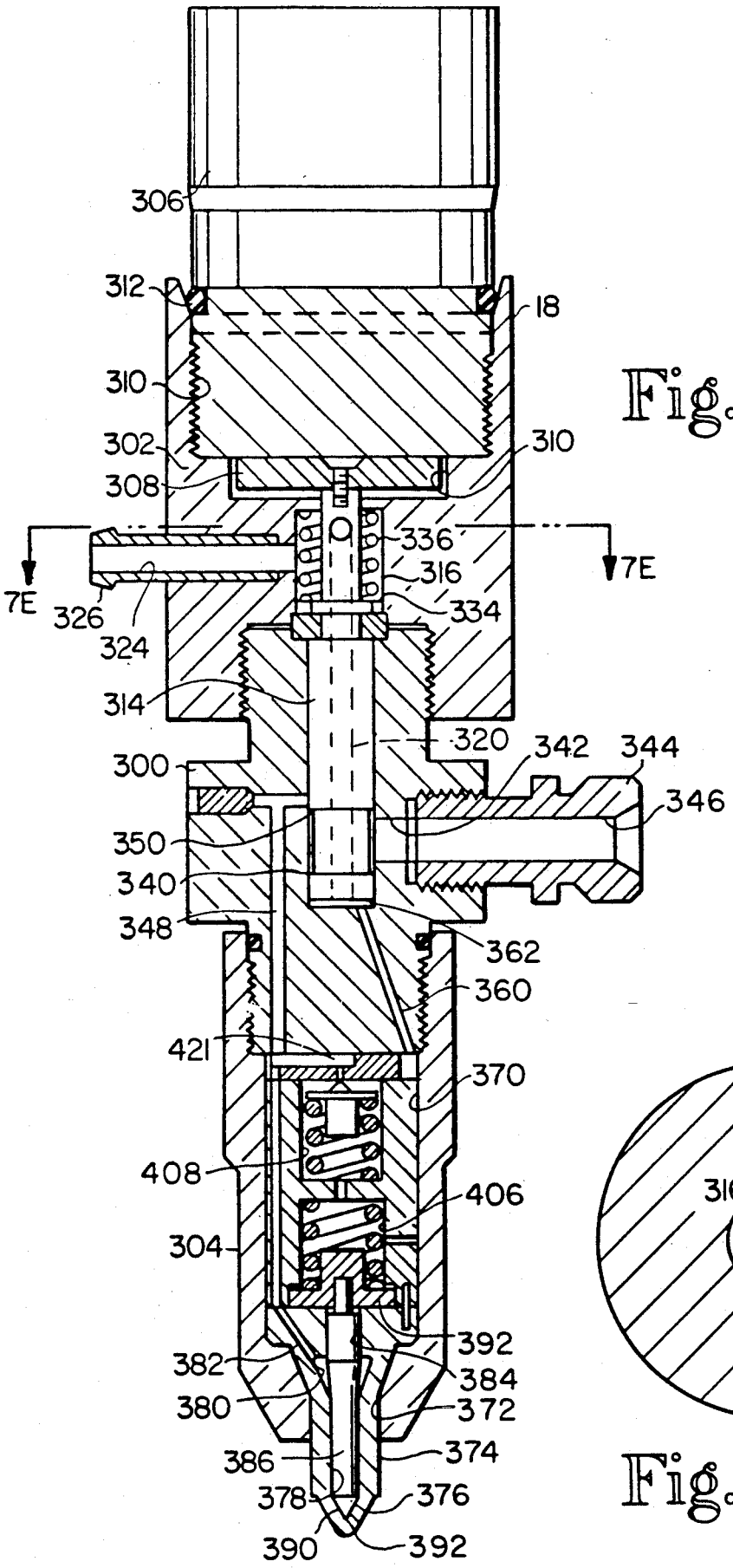
FIG. 7 is a longitudinal sectional view of a preferred electro-magnetic nozzle.
Figure 7E:
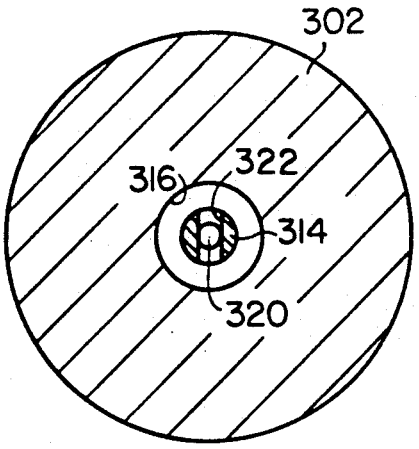
FIG. 7E is an enlarged view as seen along lines 7E—7E of FIG. 7.
Figure 7C:
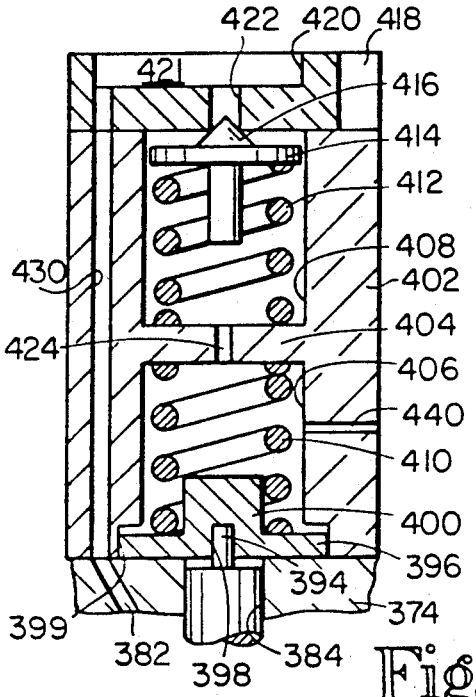
FIGS. 7C and 7D are views of the internal pressure balancing chamber.
Figure 7A:
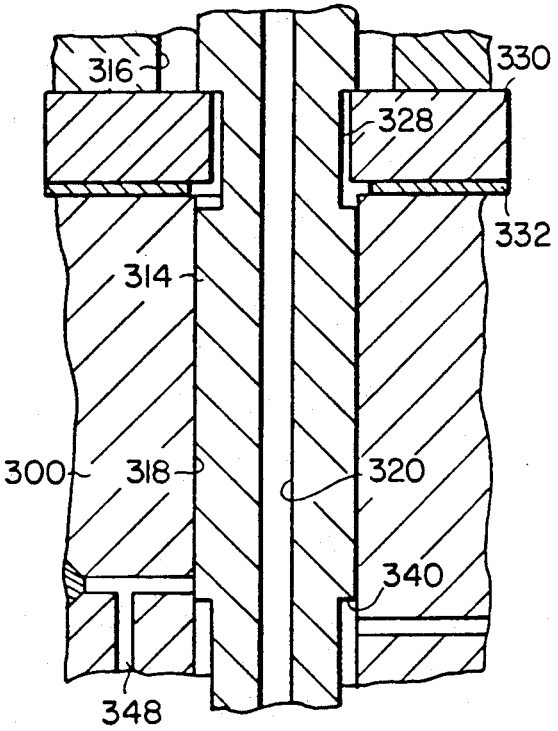
FIGS. 7A and 7B are enlarged sectional views showing the inlet opening to the fuel injection nozzle body to the delivery passage.
Figure 7D:
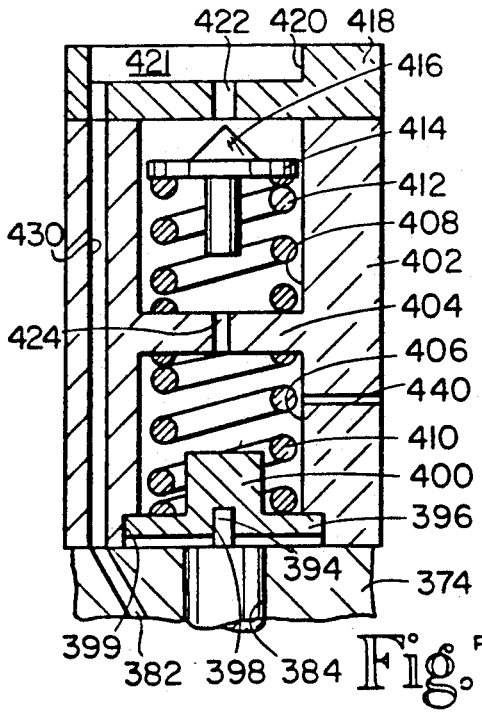
Figure 7B:
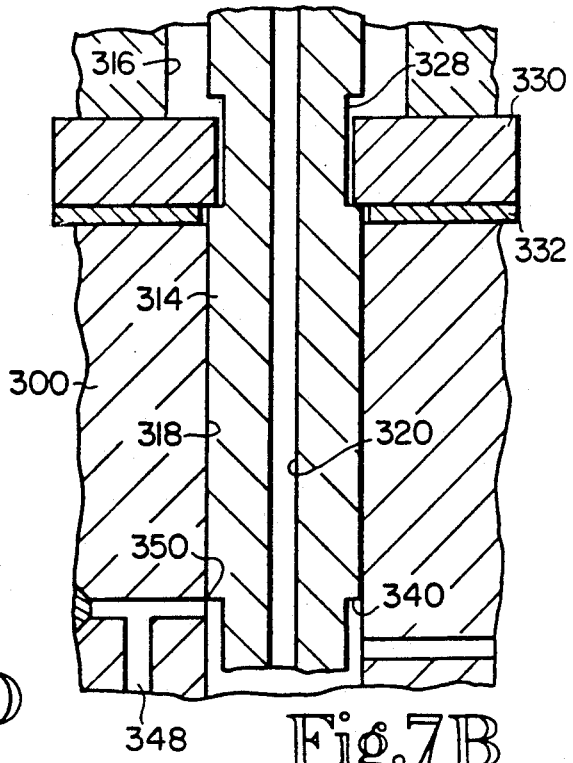

Referring to FIGS. 7A and 7B, valve 314 has an annular groove 328. An annular retaining plate 330 is mounted in the groove and has a thickness slightly less than the width of the groove. A shim 332 is mounted adjacent the retaining plate.

The difference between the thickness of the retaining plate and the width of the groove defines the length of travel of valve 314.

FIG. 7A illustrates the valve in its lower position in abutment with retaining plate 330, while FIG. 7B shows the valve in its upper position in abutment with the lower edge of retaining plate 330.

Valve 314 has an annular shoulder 334 disposed in chamber 316. A return spring 336 is mounted in the chamber with one end in abutment with nut 302, and the other end in abutment with shoulder 334 to bias valve 314 toward the retaining cap.

The valve has an annular passage 340 adjacent its lower end. The body has an internal passage 342 in communication with passage 340. A threaded fitting 344 is mounted on the body with an inlet passage 346 in communication with passage 342. Passage 342 is connected through conduit 170 for receiving fuel from the common rail chamber. The body also has a delivery passage 348 with an inlet opening 350 terminating at bore 318. The location of opening 350 is such that when valve 314 is in its lower-most position, the valve blocks fluid flow through opening 350. When the valve is in its upper position, it opens a fluid connection between annular passage 340 and inlet opening 350.

Referring to FIG. 7, the body also has a passage 360 extending from the bottom of bore 318 to the bottom of the body. A small chamber 362 is defined between the lower, extreme end of the valve and the bottom of bore 318 to provide fluid communication between passage 320 and passage 360.

Retaining cap 304 has a large internal chamber 370. Chamber 370 has a bottom opening 372. An elongated spray tip 374 is disposed in the chamber with its lower end extending through opening 372. The outer end of the spray tip has opening means 376 for passing fuel to the engine cylinder (not shown). The spray tip has an elongated, slightly tapered passage 378. The lower end of passage 378 passes fuel to opening means 376. The upper end of passage 378 is enlarged at 380 and fluidly connected to a passage 382 in the spray tip. Enlarged section 380 is tapered and terminates with a cylindrical bore 384 which extends through the upper end of the spray tip.

A needle valve 386 is mounted in passage 378. The lower end of the needle valve is tapered at 390 to seat against a tapered seat 392 in the spray tip for opening or closing fuel flow through passage means 376. The upper end of the needle valve has a narrowed end 394.

A piston 396 has a bore 398 receiving narrowed end 394 of the needle valve. Piston 396 is movable in a recess 399 to define the travel of the needle valve between its open and closed positions. The piston has a raised midsection 400.

Referring to FIGS. 7C and 7D, spring cage 402 is mounted in chamber 370. The cage has a wall 404 separating a lower balancing chamber 406, and an upper balancing chamber 408. A coil spring 410 in the lower chamber has its upper end engaging wall 404, and its lower end engaging piston 396 to urge it and the needle valve toward its closed position. A coil spring 412 in the upper chamber has its lower end engaged with wall 404. A valve 414 is mounted in the upper chamber and engages the upper end of spring 412. Valve 414 has a tapered valve section 416.

A cap 418 is mounted between the upper end of the spring cage and the lower end of body 300. Cap 418 has a cutout portion 420 forming a chamber 421 between the cap and the body 300, and an orifice 422 communicating between chamber 421 and upper balancing chamber 408. An orifice 424 in wall 404 provides communication between upper balancing chamber 408 and lower balancing chamber 406.

The cage also has a passage 430 having its upper end communicating with chamber 421, and a lower end connected to passage 382 in spray tip 374.

The cage also has a lateral orifice 440 which extends from lower chamber 406, upwardly along the wall of chamber 370 to provide communication with the lower end of passage 360.

OPERATION

Referring to FIG. 1, during engine operation, the fuel from supply 20, such as a fuel tank, is delivered at a predetermined pressure by a supply pump (not shown) to electronic pump assembly 12 through solenoid valve means 14A and 14B. The opposed pumping elements of the pump assembly draw fuel into the pumping chambers as the camshaft is turned, and then deliver the fuel to the solenoid valve assemblies.

The fuel from the pumping elements passes through the solenoid valve assemblies and is recycled to the fuel supply depending upon the position of the check valves. For example, when solenoid valve assembly 14A is energized with a certain pulse width by a signal from electronic control module 440, the solenoid armature closes the solenoid valve, the fuel pressure in passage 30 opens check valve 82 to pass fuel through fitting 76 toward the common rail.

The fuel coming from the solenoid valve assemblies enters into the common rail housing through either fitting 162 or 164, depending upon which solenoid valve assembly is in the pumping mode. The fuel is accumulated in the common rail at a predetermined pressure adjusted according to relief valve 178.

The high-pressure fuel in the common rail absorbs the pumping strokes and the reflecting pressure waves, delivering a constant, pressurized fuel to each of the electro-magnetic valves through their corresponding outlet fitting. The pressure in the common rail is monitored by a pressure transducer connected to fitting 180 which sends a signal back to electronic control module 440 which in turn opens the solenoid control valves.

FIG. 1 illustrates a practical common rail configuration using cross-drilled holes.

Figure 6A:
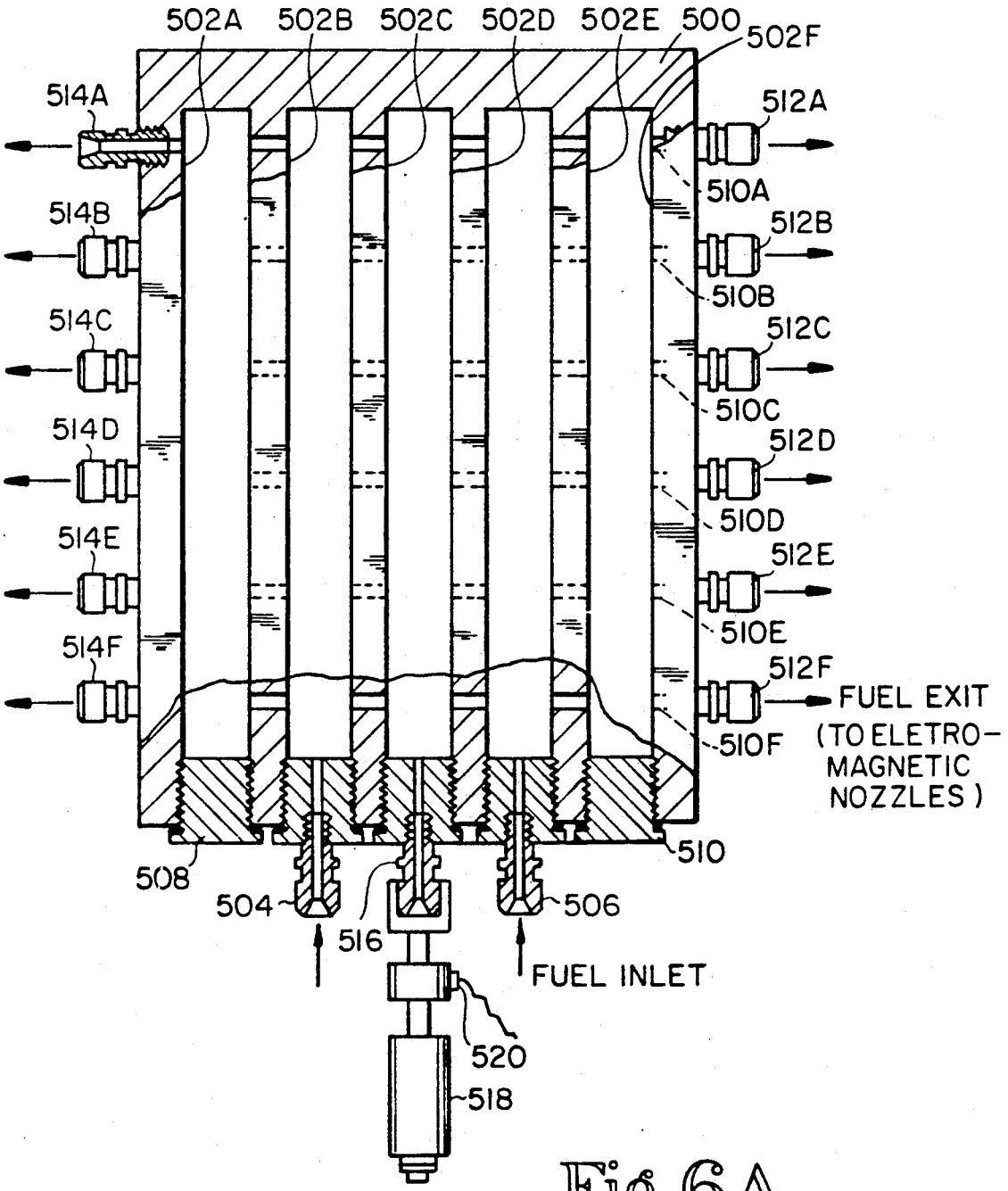
FIG. 6A is a sectional view of another preferred common rail.

FIG. 6A illustrates another common rail comprising a one-piece metal housing 500 having five drilled holes 502A, 502B, 502C, 502D, and 502E. Inlet fittings 504 and 506 are mounted at the open end of holes 502B and 502D. Each inlet fitting has an internal passage for receiving fuel. Plugs 508 and 510 are inserted in the inlet of bores 502A and 502E. The housing is cross-drilled to form passages 510A to 510F. These are completely drilled through the block and six nipples 512A to 512F are mounted at one end of the passages 510A to 510F. Six nipples 514A-514F are mounted at the opposite ends of drilled holes 510A-510F. Each of the outlet nipples is adapted to discharge fuel from the six internal chambers formed by bores 502A to 502E. A nipple 516 is mounted in the inlet of drilled hole 502C and supports relief valve 518 and a pressure transducer 520. Relief valve 518 is similar to relief valve 178 in that it regulates the maximum pressure being maintained in the common rail.

The fuel pressure from the common rail is delivered to each of the electromagnetic nozzles, entering the nozzle body through fitting 344. The fuel flow stops at valve 314 which is normally closed. When solenoid 306 is energized with a pulse width at the beginning of an injection event from module 440, the armature and valve 314 are lifted, opening fuel flow through inlet 350, passages 348, 430 and 382. The solenoid valve is pressure-balanced by the upper and lower sides of passage 340. The pressurized fuel continues to the spray tip. The fuel pressure acting against the tapered section 386 of the needle valve lifts the needle valve and permits the pressurized fuel to spray into the combustion chamber through spray opening means 376.

At the same time, the pressurized fuel from chamber 421 opens valve 416, continues downwardly into chamber 408 through orifice 424 into chamber 406. The pressure in balance chamber 406 rises at a lesser rate than is acting to raise the needle valve. The pressure in chamber 406 depends upon the net flow passing through orifices 424 and 440. Spring 412 assists in closing the needle valve.

The pumping process ends when the solenoid valves of valve means 14A and 14B are de-energized, and the return springs open the solenoid control valves such that fuel from the pump means returns to the supply conduits rather than to the common rail. The signal to de-energize is caused by the transducer 180 indicating that the common rail channel is at the predetermined level.

When solenoid 316 on the injection nozzle is de-energized, control valve 314 closes. The pressure in chamber 406 is controlled such that it is less than that being delivered to the spray tip. When the needle valve begins to close because the supply pressure has been cut-off by control valve 314, the pressure at the nozzle then drops until it is less than that urging piston 396 to close at which time the pressure in balance chamber 406, together with assistance from spring 410 abruptly closes the needle valve, ending the injection process.

Figure 2:
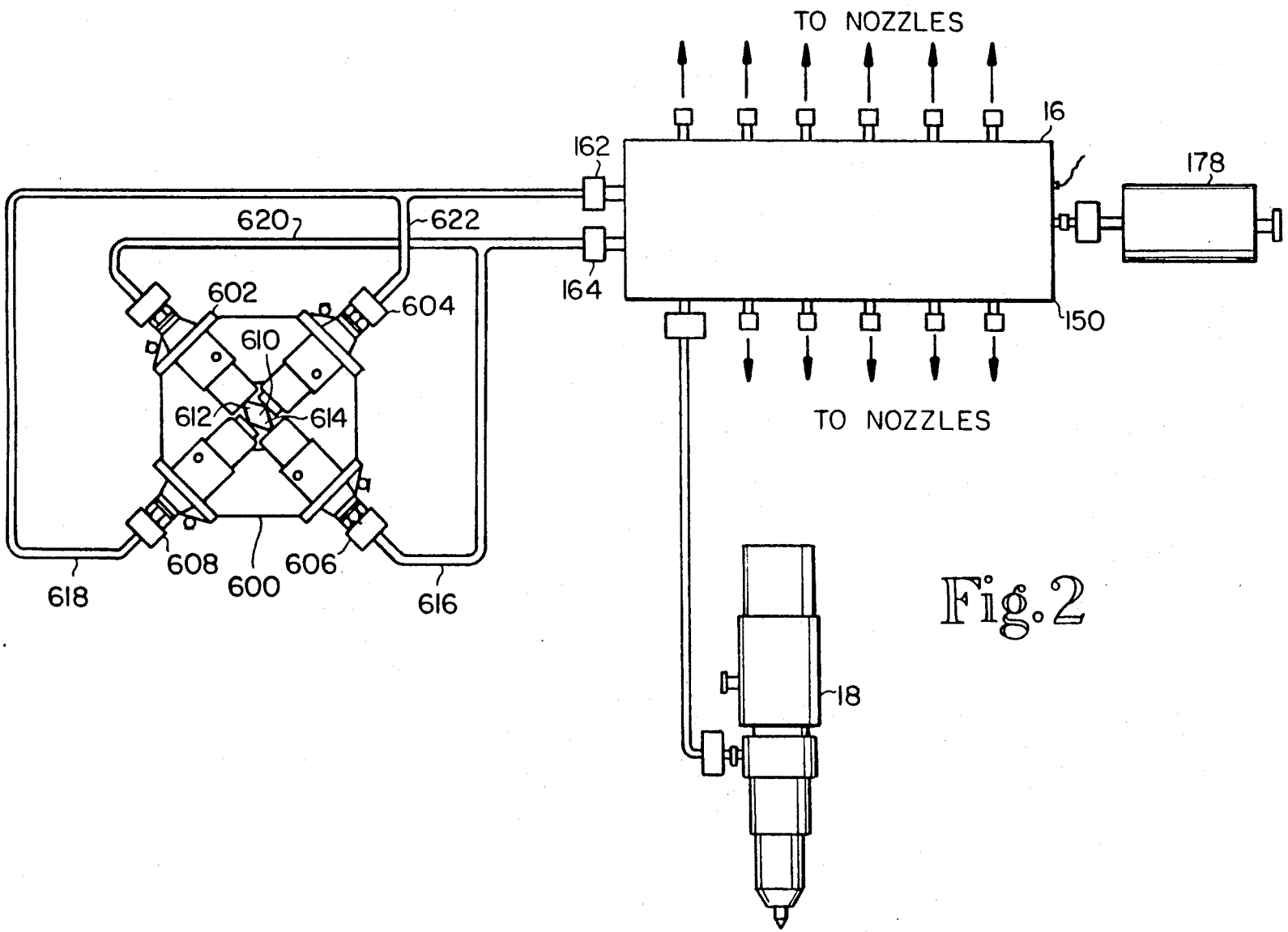
FIG. 2 illustrates a high-pressure, common-rail fuel injection system with a mechanical pump assembly.

FIG. 2 illustrates a mechanical pump assembly 600 using four standard plunger-operated, one-cylinder pumps 602, 604, 606 and 608, each having a fuel metering and timing adjusted by the plunger's helix. The plungers are energized in pairs by a crankshaft 610 having a pair of opposed cam lobes 612 and 614.

The pumps alternate in pairs in delivering fuel to common rail 16 through conduits 616, 618, 620 and 622 in a manner similar to the embodiment of FIG. 1.

Having described my invention, I claim:

1. A high pressure common rail for use in a diesel fuel injection system comprising:

a body formed of a unitary structure having a plurality of parallel first elongated bores formed from one end thereof and a plurality of second bores intersecting the first bores at right angles to the longitudinal axis thereof to form a plurality of communicating internal chambers, inlet fittings being mounted in the first bores adapted to receive fuel under pressure into the first bores and outlet fittings being mounted in the second bores for discharging fuel from the second bores, under the influence of the inlet fuel pressure; and relief valve means connected to the internal chambers to prevent the fluid pressure in the internal chambers from exceeding a predetermined level whereby the fuel pressure being discharged from the internal chambers is generally at said predetermined pressure.

* * * * *